US006541746B2

(12) United States Patent
Kim et al.

(10) Patent No.: US 6,541,746 B2
(45) Date of Patent: Apr. 1, 2003

(54) MICROWAVE OVEN WITH A CONVECTIONAL HEATING APPARATUS

(75) Inventors: Dae Sik Kim; Sang Ki Lee; Kwang Yok Kang, all of Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/996,965

(22) Filed: Nov. 30, 2001

(65) Prior Publication Data

US 2002/0063126 A1 May 30, 2002

(30) Foreign Application Priority Data

Nov. 30, 2000 (KR) ..... 00-72171
Dec. 28, 2000 (KR) ..... 00-84686

(51) Int. Cl.[7] ..... H05B 6/80

(52) U.S. Cl. ..... 219/681; 219/400; 219/685; 219/757; 126/21 A

(58) Field of Search ..... 219/681, 400, 219/685, 757; 126/21 A

(56) References Cited

U.S. PATENT DOCUMENTS

| | | | | |
|---|---|---|---|---|
| 3,692,968 A | | 9/1972 | Yasuoka | |
| 3,878,350 A | | 4/1975 | Takagi | |
| 5,674,425 A | | 10/1997 | Hong | |
| 6,005,235 A | * | 12/1999 | Shin | 219/757 |
| 6,093,919 A | * | 7/2000 | Seo et al. | 219/685 |
| 6,147,336 A | | 11/2000 | Ushijima et al. | |
| 6,297,047 B1 | * | 10/2001 | Butts | 219/400 |
| 6,344,637 B2 | * | 2/2002 | Lee et al. | 219/757 |

FOREIGN PATENT DOCUMENTS

| | | | | |
|---|---|---|---|---|
| DE | 43 22 946 A1 | | 1/1995 | |
| EP | 0 247 574 A1 | | 12/1987 | |
| EP | 0 584 934 A1 | | 3/1994 | |
| EP | 0 783 240 A2 | | 7/1997 | |
| EP | 1 058 483 A1 | | 12/2000 | |
| GB | 2 089 630 A | | 6/1982 | |
| GB | 2 152 790 A | | 8/1985 | |
| JP | 54-58237 | * | 5/1979 | 219/681 |
| JP | 5-52352 | * | 3/1993 | 219/757 |

* cited by examiner

*Primary Examiner*—Philip H. Leung
(74) *Attorney, Agent, or Firm*—Birch, Stewart, Kolasch & Birch, LLP

(57) ABSTRACT

A heating apparatus of a microwave oven includes: a heater installed at an upper portion of a cooking chamber into which foodstuff is received; a ventilating fan installed at one side of the heater, for circulating air inside the cooking chamber to pass across the heater; a panel having a suction hole installed at an upper portion of the cooking chamber, through which the air inside the cooking chamber is drawn into the ventilating fan, and a discharge hole, through which the air which has passed across the heater is again supplied to the cooking chamber; and an air guide unit mounted at an upper side of the panel, for guiding air flow from the ventilating fan to the heater.

6 Claims, 3 Drawing Sheets

MICROWAVE OVEN WITH A CONVECTIONAL HEATING APPARATUS

BACKGROUND OF THE INVENTION

1. Field of the Invention

The present invention relates to a microwave oven, and more particularly, to a heating apparatus of a microwave oven for supplying a heat source other than microwave to a cooking chamber.

2. Description of the Background Art

In general, a microwave oven generates microwave by using electricity. As the microwaves infiltrate into a cooking object, a movement of molecules is made in the cooking object, according to which the food stuff is heated.

In case of the currently used microwave oven, since there is a limitation in the to use of only microwaves as a heat source for heating foodstuff, a heating apparatus is additionally installed to heat foodstuff by using a heating source other than microwave.

FIG. 1 is a view showing the construction of a microwave oven having a heat apparatus in accordance with conventional art.

The conventional microwave oven includes: a cooking chamber 102 for receiving a cooking object; a tray 104 installed at a lower portion of the cooking chamber 102, being rotated with foodstuff placed thereon; a magnetron (not shown) mounted at one side of the cooking chamber 102, for generating microwaves for heating foodstuff; and a heating apparatus for providing a heat source (other than microwave) required for heating foodstuff generated from the magnetron.

The heating apparatus includes a heater 106 disposed at an upper portion in a cooking chamber 102, a ventilating fan 108 disposed at the center of the heater 106, for circulating air inside the cooking chamber 102 to pass across the heater 106; and an upper plate 116 installed at a certain position of an upper side of the cooking chamber 102, in which the ventilating fan 108 and the heater 106 are inserted, and having a plurality of holes for passing air.

The upper plate 116 includes suction holes 120, through which air inside the cooking chamber 102 is introduced into a circulating chamber 112, formed at the center thereof and discharge holes 120 formed in a circumferential direction, for supplying air that is heated while passing across the heater 106 into the cooking chamber 102.

As stated above, in the heating apparatus of a microwave oven, when the ventilating fan 108 is driven, air from the cooking chamber is supplied through the suction hole 120 to the heater 106 and the air heated while passing across the heater 106 is supplied through the discharge hole 120 to the cooking chamber 102, thereby heating foodstuff.

In this manner, the heating method of the heating apparatus of a conventional microwave oven adopts the air convection method in which the air inside the cooking chamber 102 is drawn into the upper central portion of the cooking chamber 102 and supplied through the upper marginal portion of the cooking chamber 102.

However, the conventional heating apparatus of a microwave oven as described above has the following problems.

That is, since it indirectly heats foodstuff according to an air circulation method wherein as the ventilating fan is driven, the air inside the cooking chamber is heated while passing the heater, and the heated air is supplied to the cooking chamber to heat foodstuff, there is much heat loss and its heating efficiency is degraded.

In addition, since the air that is heated while passing across the heater is supplied from the outer marginal portion of the cooking chamber to a central position where foodstuff is disposed, a considerable heat loss is created.

Moreover, since the conventional heat apparatus adopts the air convection method wherein air heated in the heater is circulated to heat foodstuff, the heating speed is low.

Furthermore, since the heat generated from the heater is transmitted to a peripheral device, resulting in damaging of the peripheral device, and since the heat generated from the heater is dispersed from the heater, its heating efficiency is degraded much more.

SUMMARY OF THE INVENTION

Therefore, an object of the present invention is to provide a heating apparatus of a microwave oven that is capable of improving heat efficiency by supplying air heated while passing across a heater to the center of a cooking chamber and rendering heat energy generated from the heater to be directly transmitted to a cooking object.

Another object of the present invention is to provide a heating apparatus of a microwave oven that is capable of reducing heat loss by increasing an amount of air which passes a heater by guiding air ventilated from a ventilating fan toward the heater and smoothing the air flow.

Still another object of the present invention is to provide a heating apparatus of a microwave oven that is capable of preventing heat energy generated from a heater from being transmitted to a peripheral device and reflecting the heat energy into a cooking chamber by installing a reflection plate at the heater.

To achieve these and other advantages, and in accordance with the purpose of the present invention, as embodied and broadly described herein, there is provided a heating apparatus of a microwave oven including: a heater installed at an upper portion of a cooking chamber into which foodstuff is received; a ventilating fan installed at one side of the heater, for circulating air inside the cooking chamber to pass across the heater; a panel having a suction hole installed at an upper portion of the cooking chamber, through which the air inside the cooking chamber is drawn into the ventilating fan, and a discharge hole, through which the air which has passed the heater is again supplied to the cooking chamber; and an air guide unit mounted at an upper side of the panel, for guiding air flow from the ventilating fan to the heater.

In the heating apparatus of a microwave oven of the present invention, the discharge hole for discharging heated air is formed at the center of the panel and the suction hole for sucking the air of the cooking chamber is formed at the marginal portion of the panel.

In the heating apparatus of a microwave oven of the present invention, the air guide unit includes an air guide formed to cover the heater, its lower side thereof being fixed at an upper face of the panel, and a fan housing formed to be connected to the air guide and cover the ventilating fan.

To achieve the above object, there is further provided a heating apparatus of a microwave oven including: a heater installed at an upper side of a cooking chamber into which foodstuff is received; a ventilating fan installed at one side of the heater, for circulating air inside a cooking chamber to pass across the heater; a panel having a suction hole installed at an upper side of the cooking chamber, through which the air of the cooking chamber is drawn into the ventilating fan and a discharge hole through which air which has passed across the heater is again supplied to the cooking chamber; and a reflecting plate disposed at the circumference of the heater, for preventing heat energy generated from the heater from being transmitted to a peripheral component, and reflecting the heat energy generated from the heater into the cooking chamber.

In the heating apparatus of a microwave oven of the present invention, the reflecting plate is disposed in the longitudinal direction of the heater and has a flange to be fixed at the panel formed at both ends thereof and a plurality of air passages for guiding air ventilated from the ventilating fan to the heater.

To achieve the above objects, there is also provided a heating apparatus of a microwave oven including: a heater installed at an upper side of a cooking chamber into which foodstuff is received; a ventilating fan installed at one side of the heater, for circulating air inside a cooking chamber to pass across the heater; a panel having a suction hole installed at an upper side of the cooking chamber, through which the air of the cooking chamber is drawn into the ventilating fan and a discharge hole through which air which has passed the heater is again supplied to the cooking chamber; an air guide unit mounted at an upper face of the panel, for guiding air flow from the ventilating fan to the heater; and a reflecting plate disposed at the circumference of the heater, for preventing heat energy generated from the heater from being transmitted to a peripheral component, and reflecting the heat energy generated from the heater into the cooking chamber.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments of a microwave oven of the present invention, of which the most preferred embodiment will now be described.

Figure 1:
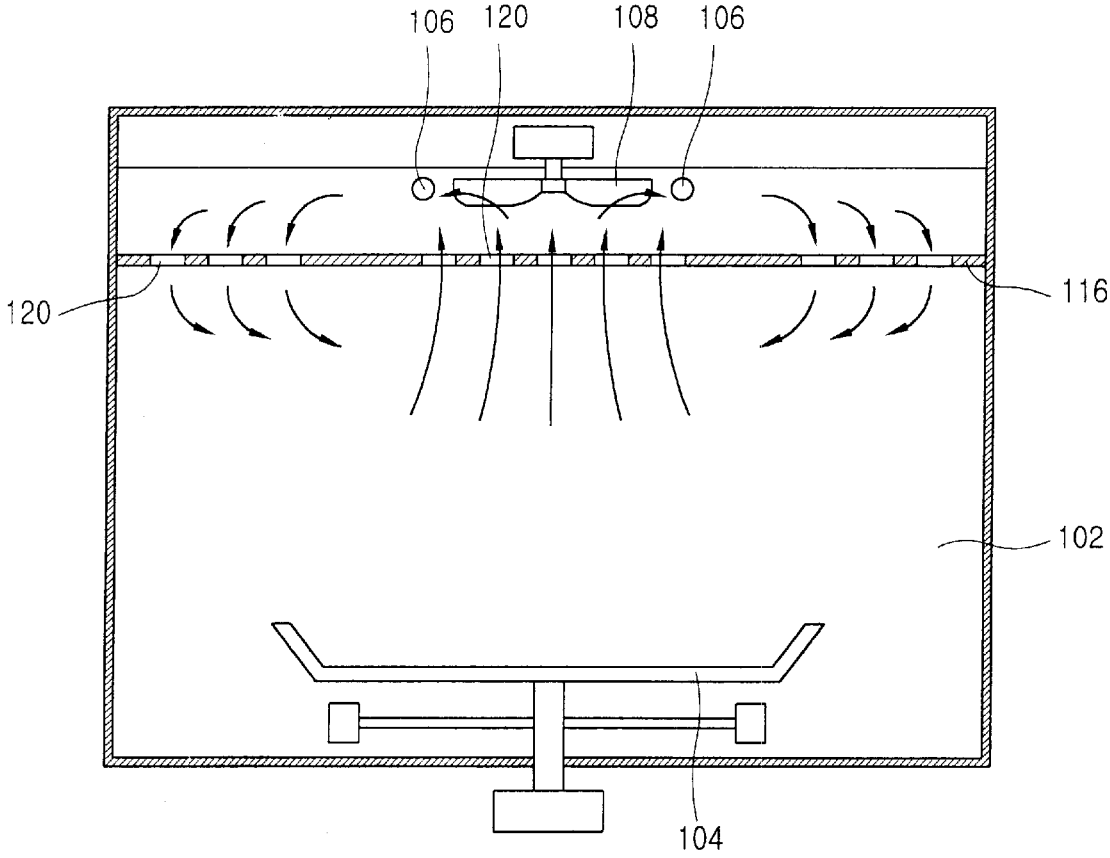
FIG. 1 CONVENTIONAL ART
FIG. 1 is a schematic view showing a microwave oven having a heating apparatus in accordance with conventional art.
Figure 2:
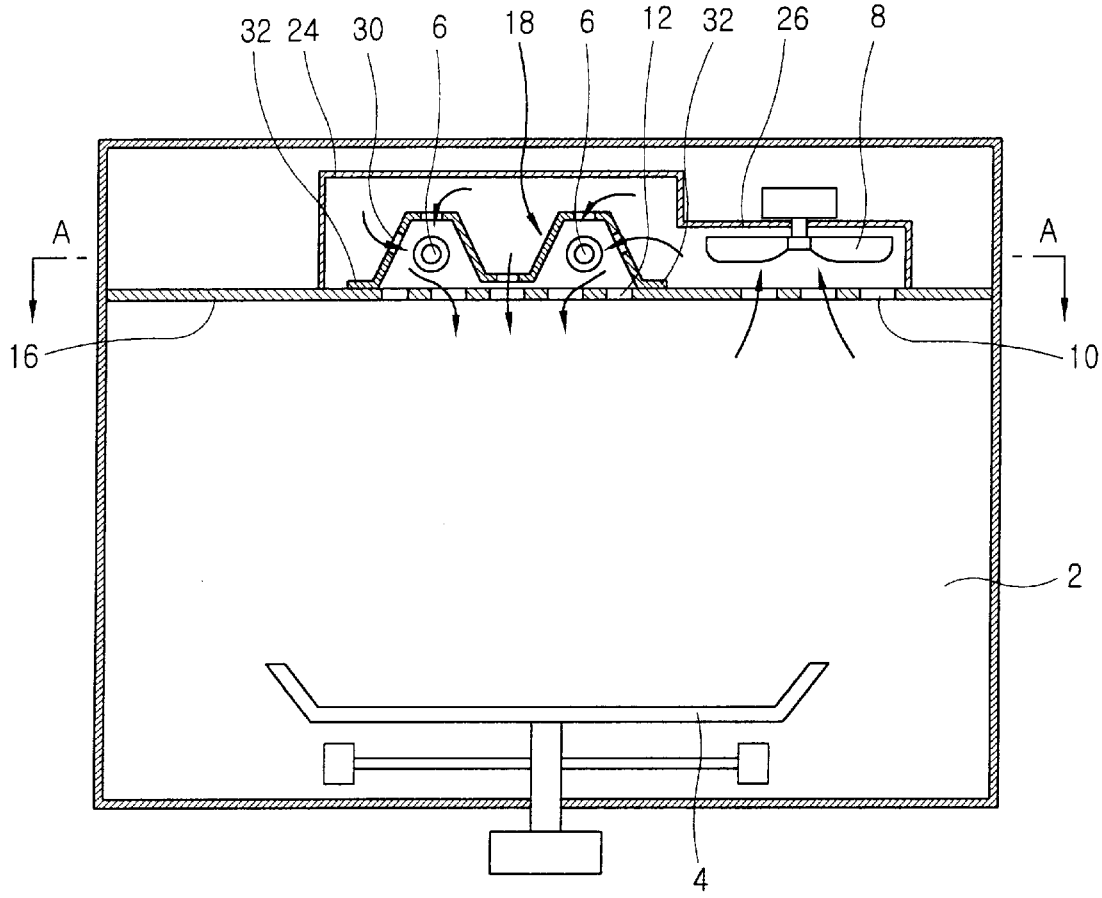
FIG. 2 is a schematic view showing a microwave oven having a heating apparatus in accordance with a preferred embodiment of the present invention.

FIG. 2 is a schematic view showing a microwave oven having a heating apparatus in accordance with a preferred embodiment of the present invention.

A microwave having a heating apparatus of the present invention includes a cooking chamber 2 for receiving foodstuff, a tray 4 being installed at a lower side of the cooking chamber 2 and rotated with foodstuff placed thereon; a magnetron (not shown) for generating microwave for heating foodstuff; and a heating apparatus for supplying a heat source required for heating the foodstuff in addition to microwaves generated from the magnetron.

The heating apparatus includes heaters 6 being disposed at the upper portion of the cooking chamber 2 with a certain distance therebetween; a ventilating fan 8 being disposed at one side of the upper portion of the cooking chamber 2 and circulating air inside the cooking chamber 2 to pass across the heater 6; and an upper plate 16 being mounted at an upper portion of the cooking chamber 2, having the ventilating fan 8 and the heater 6 inserted therein, and also having a suction hole 10 for sucking the air inside the cooking chamber 2 and a discharge hole 12 for supplying the air which has passed across the heater 6 again to the cooking chamber 2.

An air guide unit for guiding air circulated by the ventilating fan 8 toward the heater 6 is disposed to cover the ventilating fan 8 and the heater 6 at the upper side of the upper plate 16.

A reflecting plate 18 is installed at the circumferential surface of the heater, to prevent heat energy generated from the heater 6 from being transmitted to its periphery, and to reflect the heat energy into the cooking chamber 2.

The heater 6 has a bar shape disposed at a central portion of the upper side of the upper plate 16 with a certain space therebetween. Any type of heater can be used as long as it can generate heat. For example, a Halogen lamp or a ceramic heater can be adopted.

The ventilating fan 8 is disposed at one upper side of the upper plate 16 spaced apart from the heater 6 and provides a ventilating force enabling air inside the cooking chamber to be circulated.

The upper plate 16 includes a plurality of discharge holes 12 formed at the center thereof, through which the heat energy generated from the heater 6 is directly transmitted to the cooking object and air heated while passing across the heater by the ventilating pressure of the ventilating fan 8 is transmitted to the foodstuff, and a plurality of suction holes 10 are formed at the position where the ventilating fan 8 is installed, through which the air inside the cooking chamber 2 is drawn.

That is, since the discharge holes 12 of the upper plate 16 are formed at the central portion of the cooking chamber 2, the heat energy generated from the heater 6 is directly transmitted to heat the cooking object through the discharge holes 12, and in this respect, since the distance between the air heated while passing across the heater 6 and the cooking object is reduced, heat loss is reduced.

Figure 3:
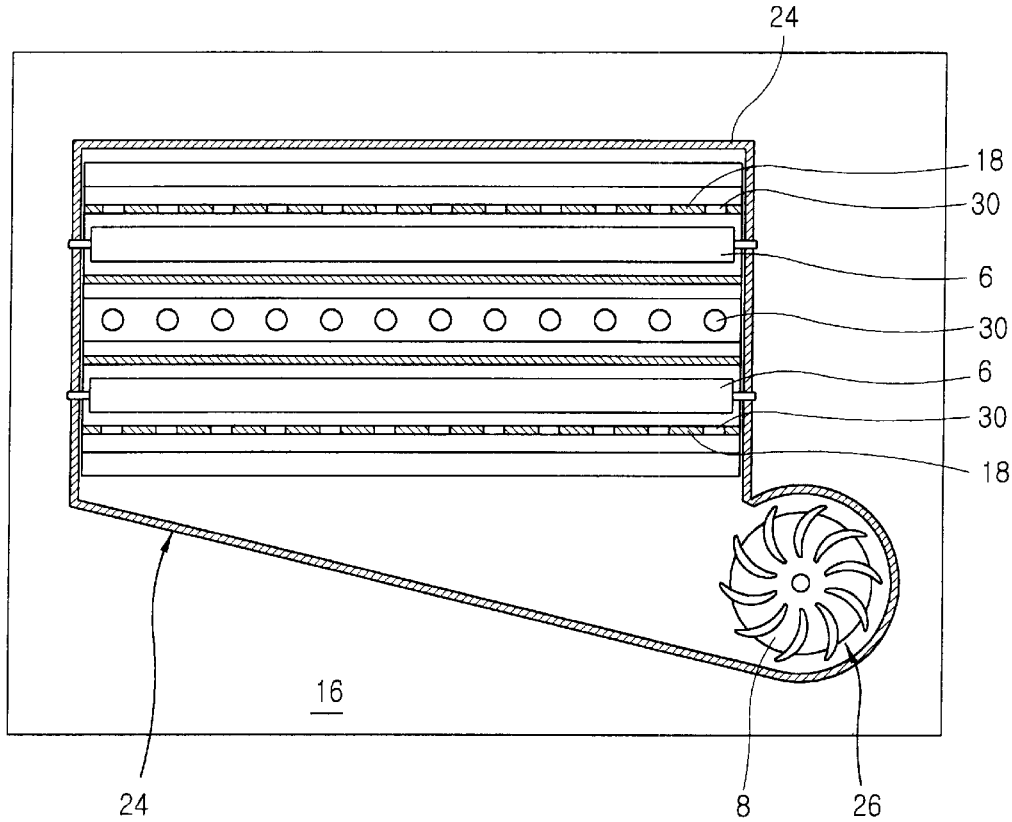
FIG. 3 is a sectional view taken along line 'A—A' of FIG. 2 showing the heating apparatus of a microwave oven in accordance with a preferred embodiment of the present invention.

FIG. 3 is a sectional view taken along line 'A—A' of FIG. 2 showing the heating apparatus of a microwave oven in accordance with the preferred embodiment of the present invention; and As shown in FIG. 3, the air guide unit includes an air guide 24 formed with one side opened, the opened face being fixed at the upper face of the upper plate 16 and covering the heater 6, and a fan housing 26 which is integrally connected to the air guide 24 and covers the ventilating fan 8.

That is, the air guide unit guides the air to flow from the ventilating fan 8 to the heater 6, and prevents the air from flowing to a portion other than to the heater 6.

Figure 4:
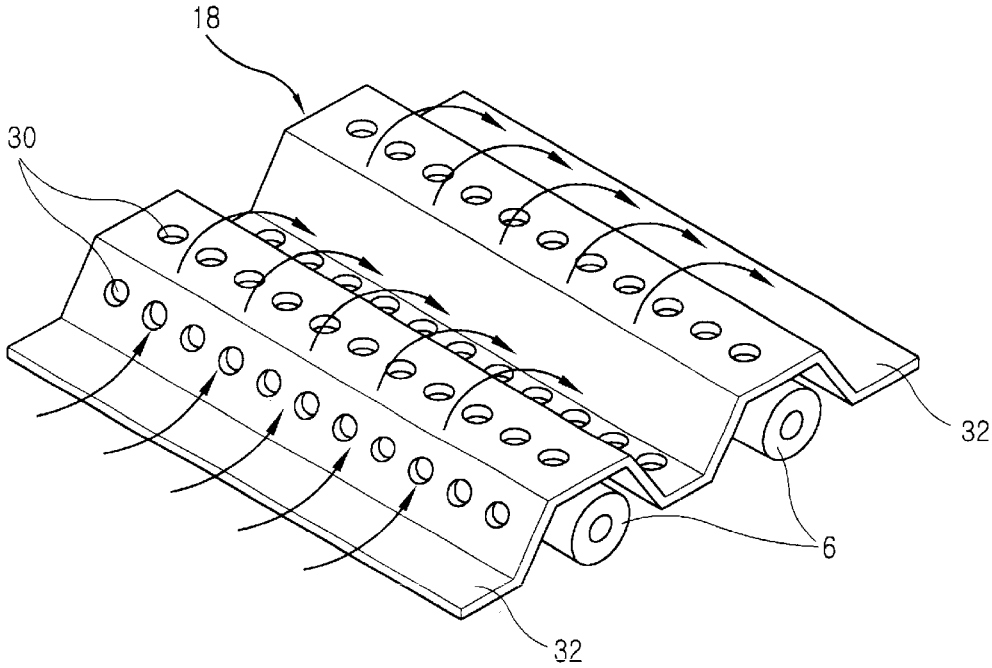
FIG. 4 is a perspective view of a heater of the heating apparatus of a microwave oven in accordance with a preferred embodiment of the present invention.

FIG. 4 is a perspective view of a heater of the heating apparatus of a microwave oven in accordance with the preferred embodiment of the present invention.

As shown in FIG. 4, the reflecting plate 18 is inserted into the air guide 24, covering the heater 6, and its lower face is opened and fixed to the upper plate 16. The reflecting plate 18 includes a plurality of air passages 30 through which air flows from the ventilating fan 8 to the heater 6.

That is, the reflecting plate 18 includes a flange 32 fixed at the upper plate 16 by a bolt at both opened ends. The reflecting plate 18 is bent to have three faces against one heater 6, of which both faces (as bent) is slantingly formed at a certain angle so as to facilitate smooth air flow. The reflecting plate 18 may be extended in the same form according to the number of the heaters 6.

The air passages 30 may be formed at all of the three faces or at two of the three faces of the reflecting plate 18.

While air ventilated from the ventilating fan 8 flows along the outer side face of the reflecting plate 18, the air is partly guided to the heater 6 through some of the air passages 30 and partly flows along the outer side face to cool the reflecting plate 18 and flows in through other air passages 30.

That is, before the air pressedly-transmitted from the ventilating fan 8 flows into the air passages 30, it flows along the outer side face of the reflecting plate 18, performing a cooling operation, to thereby prevent peripheral components from damage caused by heat generated from the heater 6.

The reflecting plate 18 reflects the heat generated from the heater 6 and guides it into the cooking chamber 2, so that heat efficiency can be increased.

The operation of the heating apparatus of a microwave oven constructed as described above will now be explained.

When the ventilating fan 8 is driven, air inside the cooking chamber 2 is drawn through the suction holes 10 and supplied to the heater 6. The air heated while passing across the heater 6 is supplied into the cooking chamber 2 through the discharge holes 12.

The suction holes 10 are positioned at the marginal portion of the cooking chamber 2 and the discharge holes 12 are positioned at the central portion of the cooking chamber 2. Thus, when the air inside the cooking chamber 2 is drawn, it is supplied to the marginal side of the cooking chamber 2, while when the air is heated and discharged, it is supplied to the central portion of the cooking chamber 2.

The air drawn by the ventilating fan 8 is guided to the heater 6 by the fan housing 26 and the air guide 24, so that the air flow can be smooth.

The air ventilated from the ventilating fan 8 to the heater 6 flows on the outer side face of the reflecting plate 18 mounted at the outer side of the heater 6, cooling the reflecting plate 18, and then flows toward the heater 6 through the air passages 30 formed at the reflecting plate 18.

The heat energy generated from the heater 6 is reflected by the reflecting plate 18, supplied into the cooking chamber 2 and directly supplied to the cooking object.

As so far described, the heating apparatus of a microwave oven of the present invention has many advantages.

For example, since the suction hole is positioned at the marginal portion of the cooking chamber and the discharge hole is positioned at the central portion of the cooking chamber, heat loss can be reduced, and in this respect, since the heat energy generated from the heater is directly transmitted to the cooking object, its heating efficiency can be improved.

Secondly, since the fan housing and the air guide are installed, respectively, at the ventilating fan and the heater, the air flow from the ventilating fan to the heater can be smooth, so that heat loss can be reduced and the amount of air passing across the heater can be increased.

Lastly, since the reflecting plate is installed at the heater, heat energy generated from the heater can be prevented from being transmitted to peripheral devices and the heat energy is reflected onto the cooking chamber, so that peripheral devices are prevented from being damaged and their efficiency can be improved As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A heating apparatus of a microwave oven comprising:

a heater installed at an upper portion of a cooking chamber into which foodstuff is received;

a ventilating fan installed at one side of the heater, for circulating air inside the cooking chamber to pass across the heater, said fan sharing a common enclosure with a reflecting plate covering said heater, and being disposed at a height lower than a height of said reflecting plate;

an upper plate installed at an upper portion of the cooking chamber, having a suction hole through which the air inside the cooking chamber is drawn into the ventilating fan, and a discharge hole, through which the air which has passed across the heater is again supplied to the cooking chamber; and an air guide unit mounted at an upper side of the upper plate, for guiding an air flow from the ventilating fan to the heater.

2. The apparatus of claim 1, wherein the discharge hole for discharging heated air is formed at the center of the upper plate and the suction hole for sucking the air of the cooking chamber is formed at the marginal portion of the upper plate.

3. The apparatus of claim 1, wherein the air guide unit comprises:

an air guide formed to cover the heater, its lower side thereof being fixed at an upper face of the upper plate; and a fan housing formed to be connected to the air guide and cover the ventilating fan.

4. A heating apparatus of a microwave oven comprising:

a heater installed at an upper side of a cooking chamber into which foodstuff is received;

a ventilating fan installed at one side of the heater, for circulating air inside a cooking chamber to pass across the heater;

an upper plate installed at an upper side of the cooking chamber, having a suction hole, through which the air of the cooking chamber is drawn into the ventilating fan, and a discharge hole through which air which has passed the heater is again supplied to the cooking chamber; and a reflecting plate disposed at the circumference of the heater, for preventing heat energy generated from the heater from being transmitted to peripheral components, and reflecting the heat energy generated from the heater into the cooking chamber, said reflecting plate sharing a common enclosure with said ventilating fan, and having a height that is higher than a height of said ventilating fan.

5. The apparatus of claim 4, wherein the reflecting plate is disposed in the longitudinal direction of the heater and has a flange fixed at the upper plate formed at both ends thereof and a plurality of air passages for guiding air ventilated from the ventilating fan to the heater.

6. A heating apparatus of a microwave oven comprising:

a heater installed at an upper side of a cooking chamber into which foodstuff is received;

a ventilating fan installed at one side of the heater, for circulating air inside a cooking chamber to pass across the heater;

an upper plate installed at an upper side of the cooking chamber, having a suction hole through which the air of the cooking chamber is drawn into the ventilating fan, and a discharge hole through which air which has passed across the heater is again supplied to the cooking chamber;

an air guide unit mounted at an upper face of the upper plate, for guiding air flow from the ventilating fan to the heater, said air guide having a common upper surface with a fan housing, said fan housing having a height lower than a height of said air guide; and a reflecting plate disposed at the circumference of the heater, for preventing heat energy generated from the heater from being transmitted to peripheral components, and reflecting the heat energy generated from the heater into the cooking chamber.

* * * * *